US007632111B2

(12) United States Patent
Xiong et al.

(10) Patent No.: US 7,632,111 B2
(45) Date of Patent: Dec. 15, 2009

(54) ELECTRICAL CONNECTOR AND METHOD OF MAKING CONTACTS THEREOF WITH ELECTRICAL CONNECTOR AND METHOD OF MAKING THE SAME

(75) Inventors: Feng Xiong, Kunshan (CN); Hong-Qiang Han, Kunshan (CN); Lun-Song Hu, Kunshan (CN); Zi-Qiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/220,495

(22) Filed: Jul. 24, 2008

(65) Prior Publication Data

US 2009/0029575 A1 Jan. 29, 2009

(30) Foreign Application Priority Data

Jul. 24, 2007 (CN) ..... 2007 2 0040972

(51) Int. Cl.
*H01R 12/00* (2006.01)
*H01R 24/00* (2006.01)

(52) U.S. Cl. ..... 439/79; 439/660

(58) Field of Classification Search ..... 439/79, 439/80, 660
See application file for complete search history.

(56) References Cited

U.S. PATENT DOCUMENTS 4,802,860 A * 2/1989 Kikuta ..... 439/79
5,192,228 A * 3/1993 Collins et al. ..... 439/567
5,213,515 A * 5/1993 Ishikawa et al. ..... 439/79
5,221,212 A * 6/1993 Davis ..... 439/108
5,254,010 A * 10/1993 Davis ..... 439/108
5,580,269 A * 12/1996 Fan ..... 439/79
5,823,799 A * 10/1998 Tor et al. ..... 439/79
5,980,273 A * 11/1999 Yong et al. ..... 439/79
6,179,630 B1 * 1/2001 Chang ..... 439/79
6,217,347 B1 * 4/2001 Schell et al. ..... 439/79
6,431,882 B1 * 8/2002 Noda et al. ..... 439/79
6,461,173 B1 * 10/2002 Mizuno et al. ..... 439/79
7,134,886 B2 * 11/2006 Okamura et al. ..... 439/79
7,207,809 B2 * 4/2007 Sasaki et al. ..... 439/79
7,341,462 B2 * 3/2008 Matsuoka et al. ..... 439/79
7,445,469 B2 * 11/2008 Wu ..... 439/79

(Continued)

*Primary Examiner*—Michael C Zarroli
*Assistant Examiner*—Vladimir Imas
(74) *Attorney, Agent, or Firm*—Wei Te Chung; Andrew C. Cheng; Ming Chieh Chang

(57) ABSTRACT

An electrical connector (100) includes an insulative housing (2), a plurality of contacts (3) retained therein, and a metal shield (1) enclosing the insulative housing (2). The contacts (3) comprise a group of first contacts (31) and a group of second contacts (32). Each contact (3) has a body portion (34), a contact portion (33) and a soldering portion (35). The soldering portions (35) are adapted to be surface-mounted to a circuit board. The body portion (35) has a first bending portion (341) joined with the contact portion (33), and a second bending portion (342) joined with the soldering portion (35). The body portions (34) of the first contacts (31) and the second contacts (32) are arranged in two rows along a front to back direction. The body portion (34) of the first contact (31) comprises a third bending portion (343) between the first bending portion (341) and the second bending portion (342) for making the soldering portion in a common plane.

18 Claims, 10 Drawing Sheets

U.S. PATENT DOCUMENTS 7,445,504 B1 * 11/2008 Zhang ..... 439/607
2001/0006854 A1 * 7/2001 Moriwake et al. ..... 439/78
2006/0068620 A1 * 3/2006 Okamura et al. ..... 439/79
2007/0066115 A1 3/2007 Saito et al.
2008/0318451 A1 * 12/2008 Lu et al. ..... 439/79

* cited by examiner

ELECTRICAL CONNECTOR AND METHOD OF MAKING CONTACTS THEREOF WITH ELECTRICAL CONNECTOR AND METHOD OF MAKING THE SAME

BACKGROUND OF THE INVENTION

1. Field of the Invention

The present invention relates to an electrical connector and method of making contacts thereof, and more particularly to electrical connectors with surface-mounted contact.

2. Description of Related Art

As is well known, a variety of electrical connectors are mounted to a printed circuit board by soldering terminals of such electrical connector to the surface of the printed circuit board. Such electrical connector usually comprises an insulative housing and a plurality of terminals. The insulative housing defines a plurality of passageways for receiving the terminals therein. Each terminal has a contact portion for connecting with a corresponding plug, a soldering portion extending flatly for being surface-mounted on the circuit board, and a body portion therebetween. With rapid development of electrical industrial, a number of terminals are set in the electrical connector for increasing the speed of signal transmission. The body portions of the terminals usually need to be arranged in several rows for increasing the distance between adjacent contacts, therefore decreasing the crosstalk there between. The soldering portions are arranged in one row and located at a common plane for being surface-mounted on the circuit board firmly.

However, the terminals of different rows need to be inserted into the insulative housing respectively. Because the body portions of the terminals are located at different plane, the soldering portions of all terminals will not be formed by one time. When the soldering portions of the terminals are formed before assembling, the small error of the length between soldering portions of different rows, and error between the terminals of different rows as assembled into the insulative housing respectively, will not make the soldering portions located at one row. It will affect the connection between the soldering portions and the circuit board. In addition, the soldering portions of different rows will turn up or distort in process of assembling, which can not ensure coplanarity of the soldering portion. Therefore, it is disadvantageous to solder the soldering portions to the circuit board firmly.

Hence, an electrical connector is desired to overcome the disadvantage of the prior art.

BRIEF SUMMARY OF THE INVENTION

According to the present invention, an electrical connector comprises an insulative housing, a plurality of contacts retained therein, and a metal shield enclosing the insulative housing. The contacts comprise a group of first contacts and a group of second contacts. Each contact has a body portion, a contact portion and a soldering portion. The soldering portions are adapted to be surface-mounted to a circuit board. The body portion has a first bending portion joined with the contact portion, and a second bending portion joined with the soldering portion. The body portions of the first contacts and the second contacts are arranged in two rows along a front to back direction. The body portion of the first contact comprises a third bending portion between the first bending portion and the second bending portion.

According to another aspect of the present invention, a method of making contacts of an electrical connector comprises: firstly, stamping a group of first contacts and a group of second contacts from two pieces of metal sheet respectively. Each contact comprises a contact portion, a securing portion, a body portion and a soldering portion which are all located in a common plane. The contact portions of the first contacts being shorter than that of the second contacts. Secondly, bending a first bending portion downwardly at a rear end of each securing portion. Thirdly, bending a third bending portion at a lower portion of the body portion of each first contact. The angle between the soldering portion and the horizontal of the first contact is similar to that of the second contact. Fourthly, assembling the first and second contacts in the electrical connector, the lower portions of the body portions of the first and second contacts are located at one row along a front to back direction. And finally, bending a second bending portion at a lower end of the body portion of all contacts by one time, the soldering portions of all contacts are in a common plane.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
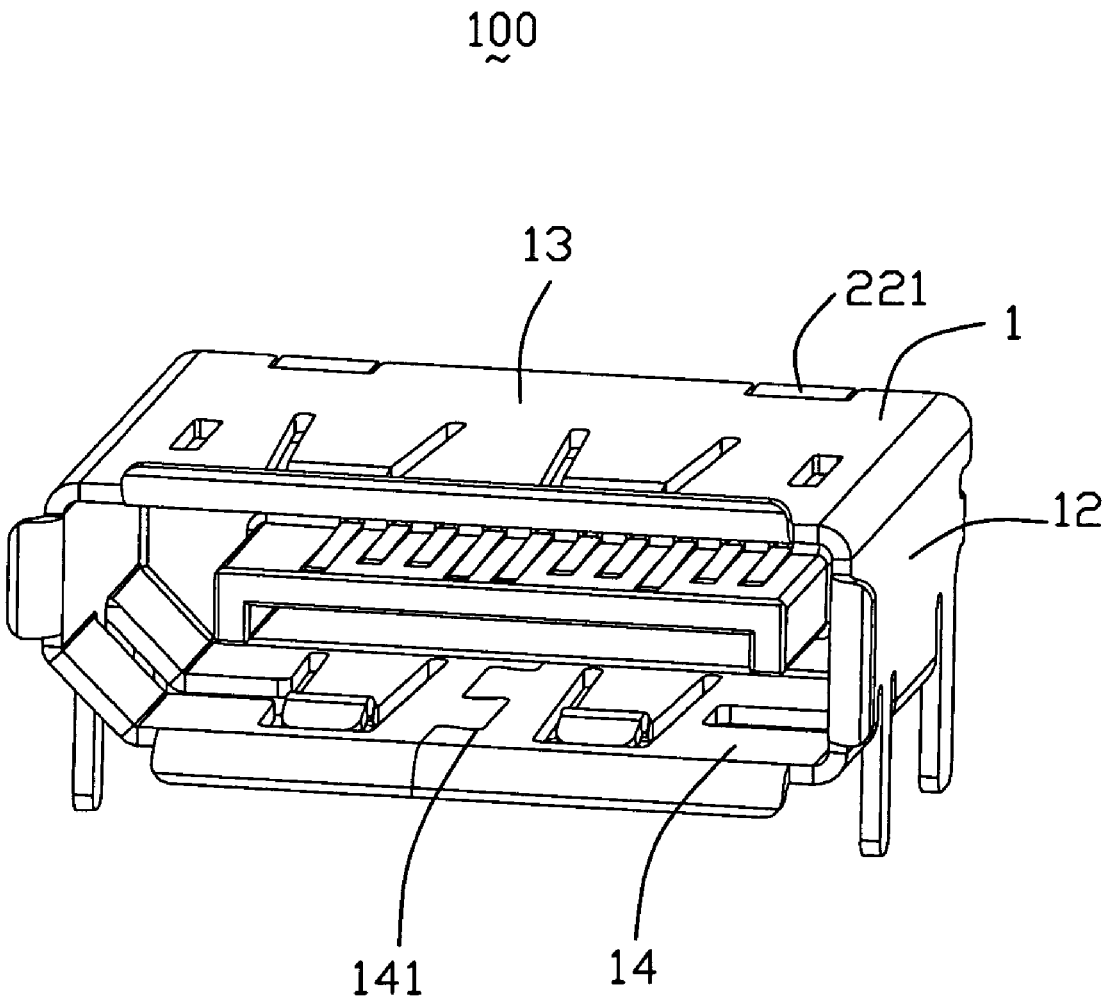
FIG. 1 is a perspective view of an electrical connector according to one embodiment of the present invention.
Figure 2:
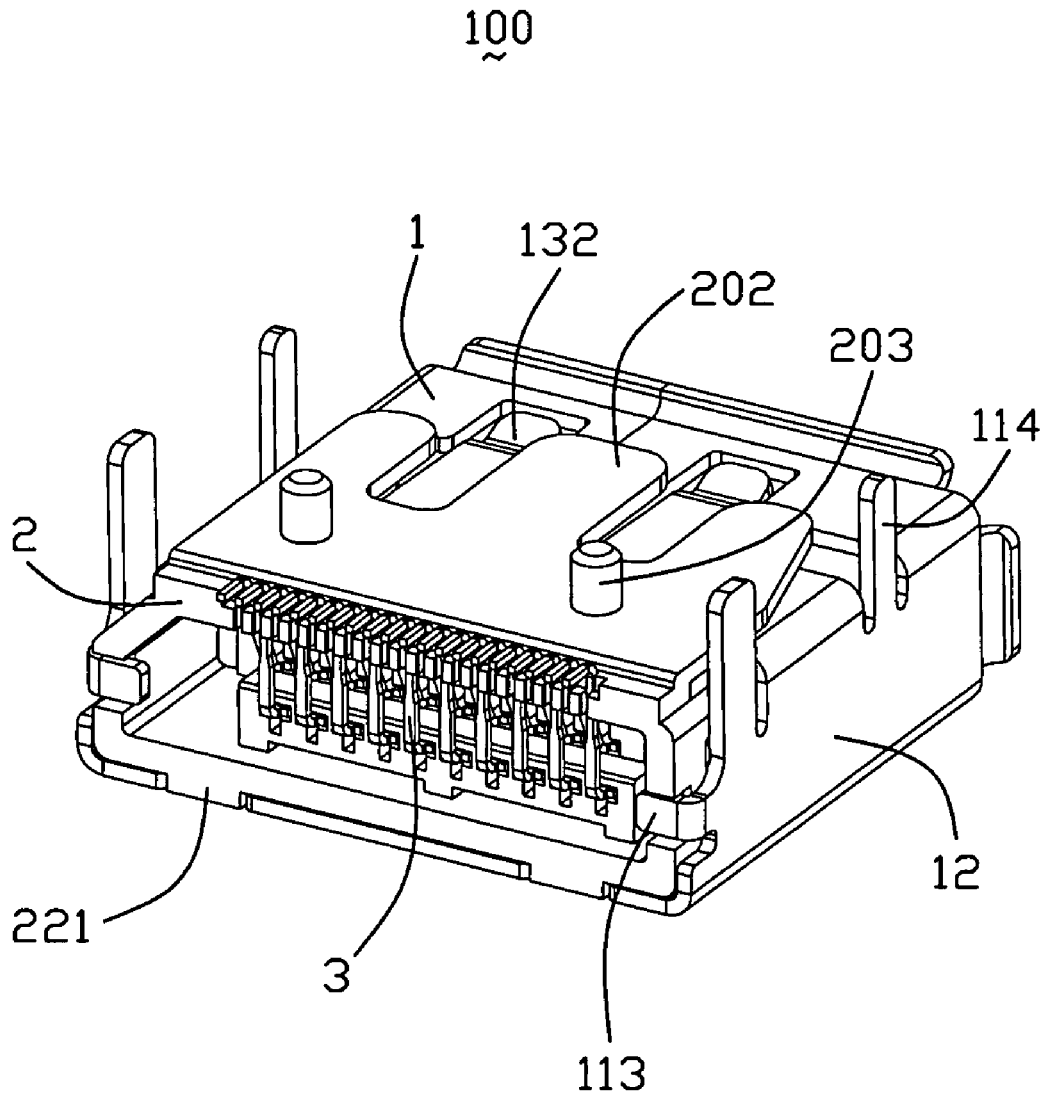
FIG. 2 is a view similar to FIG. 1, while taken from another aspect.
Figure 3:
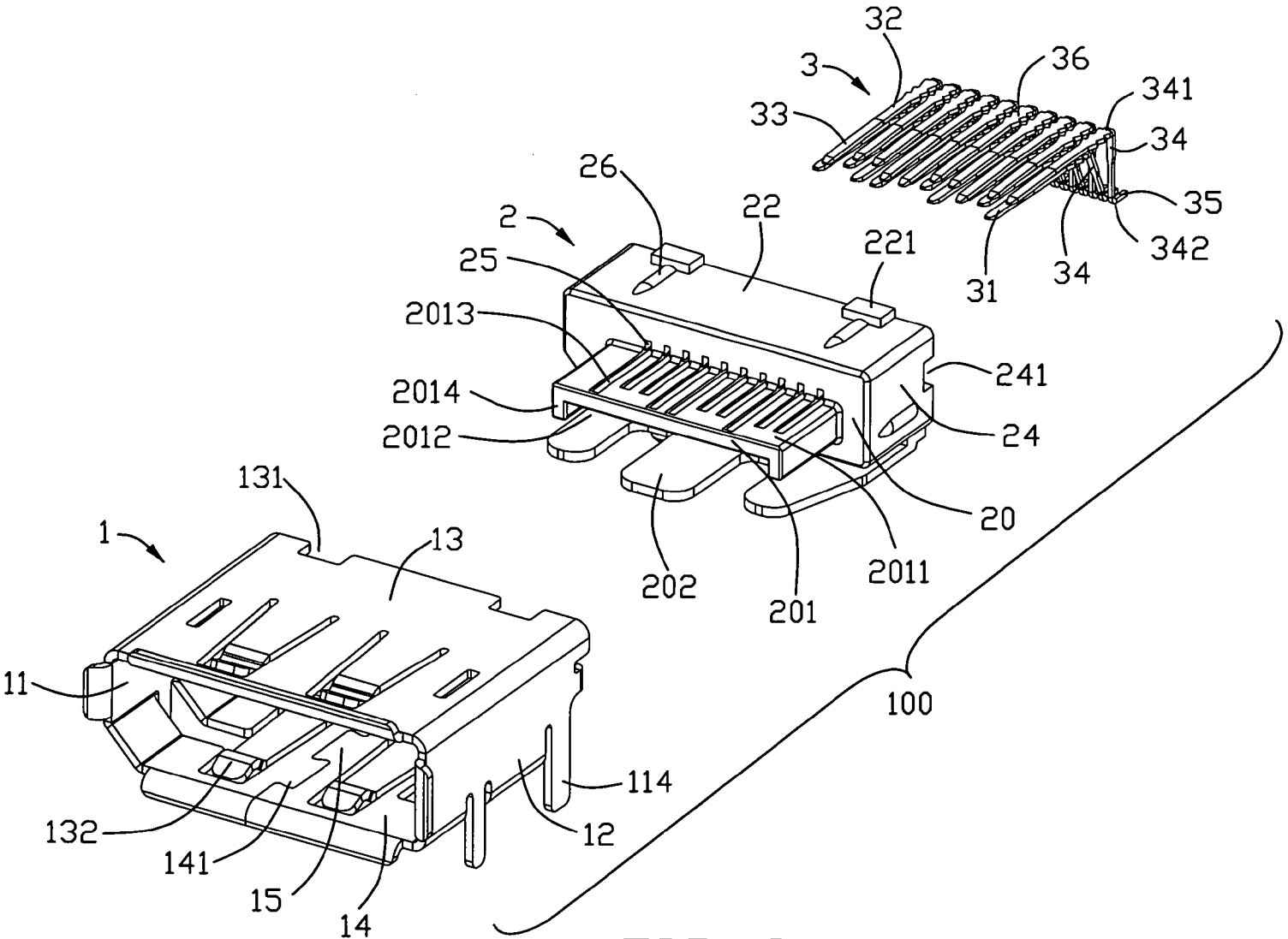
FIG. 3 is an exploded view of the electrical connector.
Figure 4:
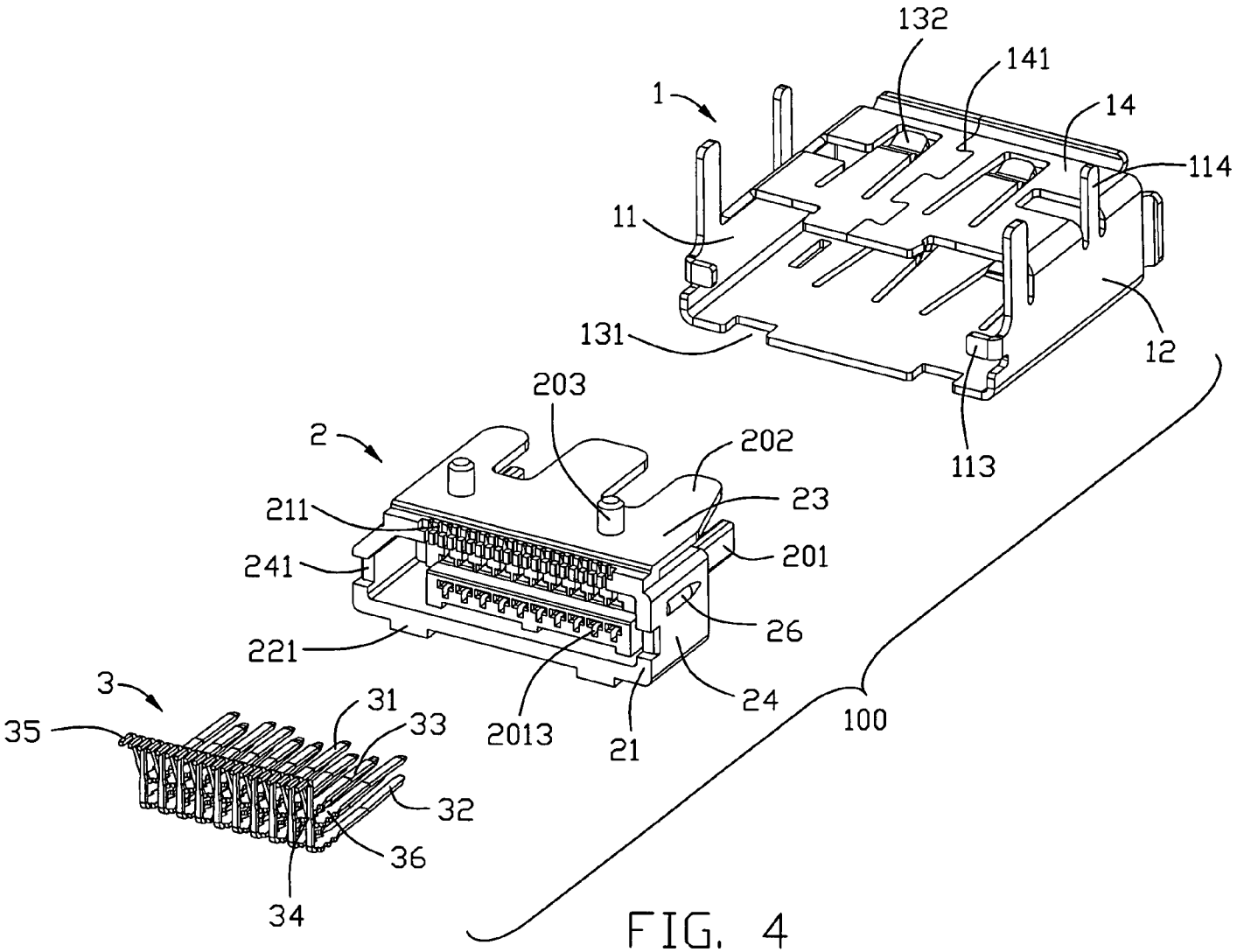
FIG. 4 is a view similar to FIG. 3, while taken from another aspect.
Figure 5:
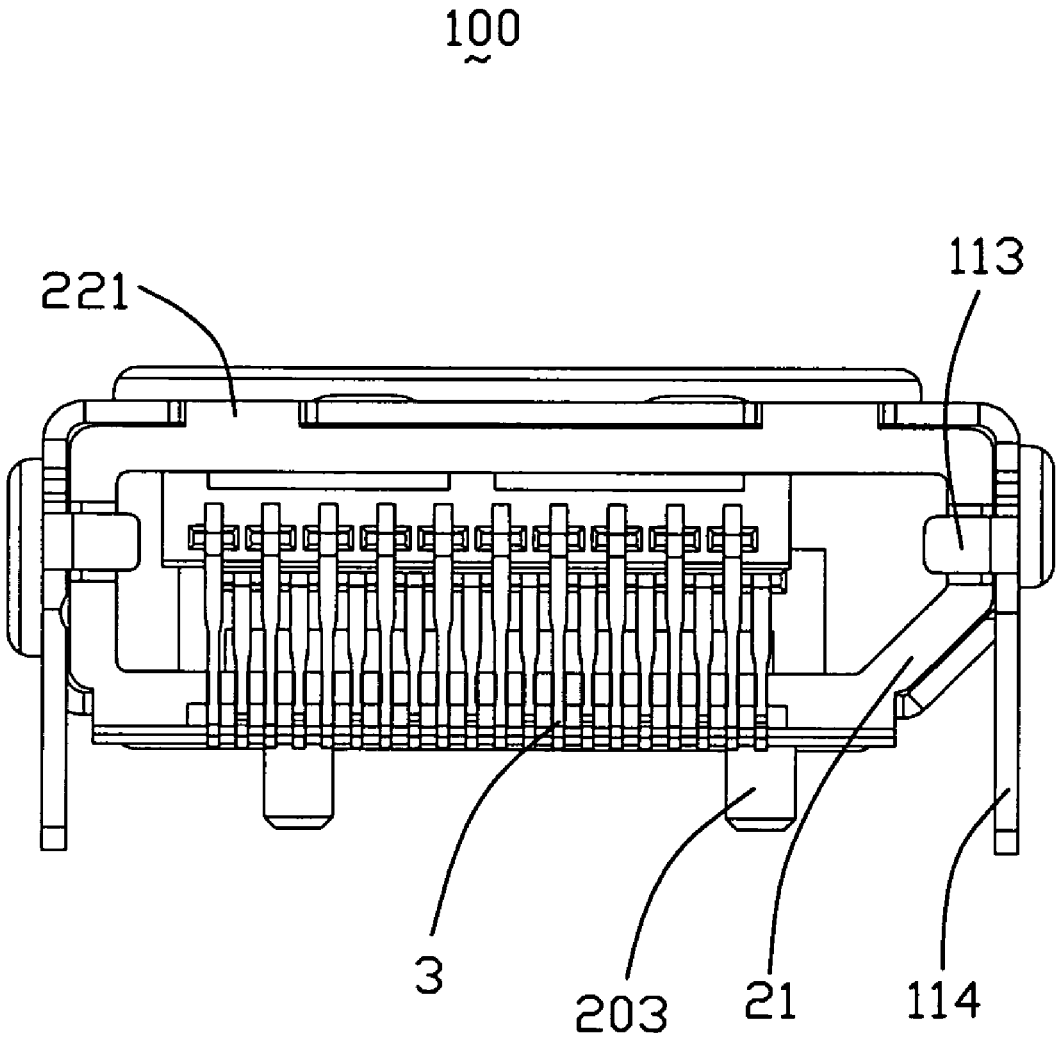
FIG. 5 is a rear elevational view of the electrical connector.
Figure 6:
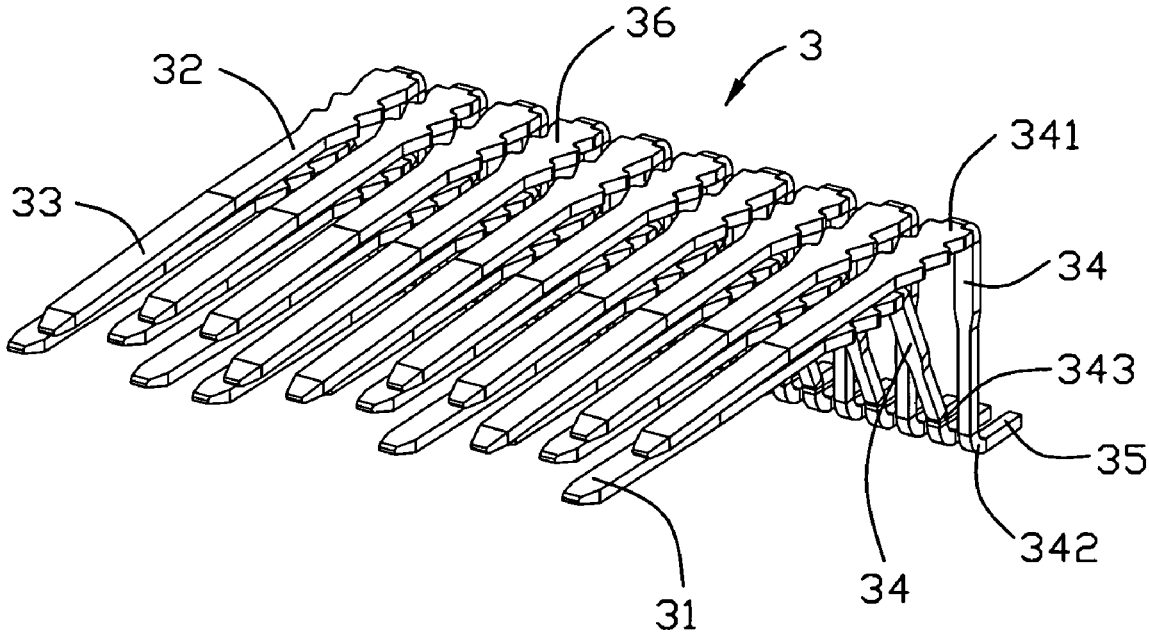
FIG. 6 is a perspective view of contacts of the electrical connector.
Figure 7:
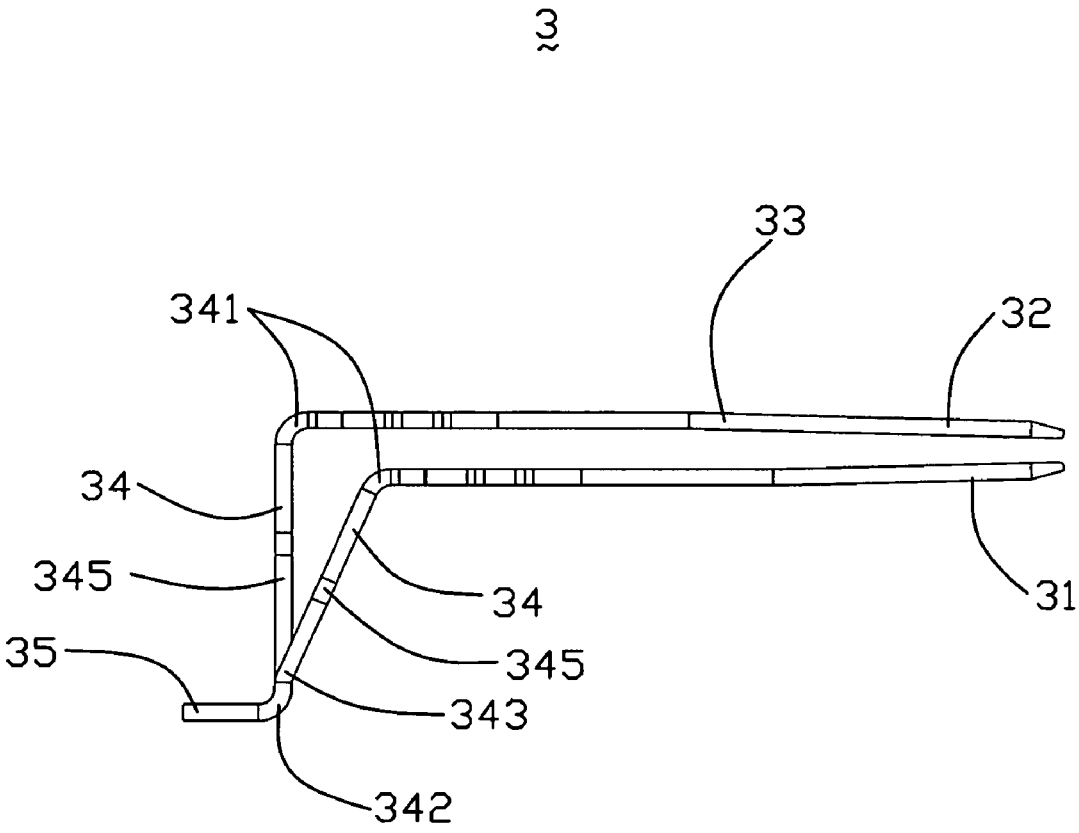
FIG. 7 is a left side elevational view of the contacts.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-7, an electrical connector 100 for receiving a corresponding plug (not shown) is disclosed in accordance with the present invention. The electrical connector 100 comprises an insulative housing 2, a plurality of contacts 3 retained in the insulative housing 2, and a metal shield 1 enclosing the insulative housing 2.

The metal shield 1 is stamped by a metal sheet. The metal shield 1 comprises a receiving space 15 surrounded by a left wall 11, a right wall 12, a top wall 13 and a bottom wall 14. The top wall 13 defines a pair of apertures 131 at a rear end thereof. The left wall 11 is anisomerous with the right wall 12 for avoiding the corresponding plug from mismating. The left wall 11 and right wall 12 each has a locking barb 113 extending backwardly and a pair of mounting legs 114 extending downwardly. The mounting legs 114 are adapted to be mounted to a circuit board (not shown). The top wall 13 and bottom wall 14 each has a pair of spring arms 132 extending into the receiving space 15 for abutting against the corresponding plug. The bottom wall 14 has a joined portion 141 to lock the left half portion and the right half portion thereof with each other.

The insulative housing 2 is received in the receiving space 15 and comprises a front wall 20, a rear wall 21 opposite to the front wall 20, an upper wall 22, a lower wall 23 opposite to the upper wall 22, and a pair of side walls 24 between the upper and lower wall 22, 23. A tongue plate 201 extends forwardly from the front wall 20. The tongue plate 201 presents as U shape and comprises a pair of opposite upper surface 2011 and lower surface 2012, and a pair of ribs 2014 extending downwardly from two sides thereof. A plurality of passageways 2013 are concaved from the upper and lower surface 2011, 2012 and extend to the rear wall 21 of the insulative housing 2 for retaining the contacts 3 therein.

The insulative housing 2 has an accessory plate 202 extending forwardly from the lower wall 23. The accessory plate 202 is spaced from the tongue plate 201 along a height direction of the insulative housing 2. A pair of posts 203 extend downwardly from the lower wall 23 for positioning the insulative housing 2 on the circuit board. The accessory plate 202 is located at a lower position of the bottom wall 14 for preventing the joined portion 141 from splitting. The rear wall 21 defines a plurality of slots 211 corresponding to the passageways 2013 for fastening the contacts 3. The upper wall 22 has a pair of projections 221 for engaging with the apertures 131 of the metal shield 1. The side wall 24 defines a recess 241 engaging with the blocking barb 113. In addition, the upper wall 22 and side walls 24 comprise a plurality of protrusions 26 for engaging with the metal shield 1.

The contacts 3 are retained in the insulative housing 2 and comprises a group of first contacts 31 and a group of second contacts 32. Each contact 3 has a body portion 34, a contact portion 33 extending forwardly from the body portion 34, a soldering portion 35 extending backwardly from the body portion 34, and a securing portion 36 between the contact portion 33 and the body portion 34. The securing portions 35 engage with the passageways 2013 for fixing the contacts 3 in the insulative housing 2. The contact portions 33 of the second contacts 32 are located at the passageways 2013 of the upper surface 2011 and exposed thereof. The contact portions 33 of the first contacts 31 are located at the passageways 2013 of the lower surface 2012 and exposed thereof, and staggered with the contact portions 33 of the second contacts 32 along the height direction. The body portions 34 are received in the slots 211. The soldering portions 35 extend flatly for fixing to the circuit board by surface-mounted technology.

Each body portion 34 comprises a main portion 345, a first bending portion 341 joined the main portion 345 and the securing portion 33 together, and a second bending portion 342 joined with the soldering portion 35. The body portion 34 of the first contact 31 also has a third bending portion 343 between the main portion 345 and the second bending portion 342. The body portions 34 of the first contacts 31 and the second contacts 32 are arranged in two rows along a front to back direction. Wherein the body portions 34 of the first contacts 31 are located at a front row close to the rear wall 21, the body portions 34 of the second contacts 32 are located at a rear row behind the front row and staggered with the first contacts 31 along the front to back direction. The angle of the first bending portion 341 of the first contacts 31 is larger than that of the second contacts 32. The third bending portions 343 of the first contacts 31 are adapted to make a lower end of the first contacts 31 locate between the second contacts 32 and arranged in one row with the second contacts 32. Therefore, the soldering portions 35 of the first and second contacts 31, 32 would be stamped at one time. The second bending portions 342 of the first and second contacts 31, 32 will be arranged at one row and located at a common arc face. All soldering portions 35 will be located at a common plane. In addition, the soldering portions 35 are arranged in one row and have same length. Thereby, the contacts 3 will be soldered to the circuit board easily and firmly.

The method of making the contacts 3 comprises steps as follows. firstly, stamping the plurality of first and second contacts 31, 32 from two piece of metal sheet respectively, the contact portions 33, securing portions 36, body portions 34 and soldering portions 35 of the first contacts 31 are located at a common plane at this time, and the contact portions 33, securing portions 36, body portions 34 and soldering portions 35 of the second contacts 32 are located at another common plane at this time. The contact portions 33 of the first contacts 31 are shorter than that of the second contacts 32. Secondly, bending the first bending portions 341 downwardly at a rear end of the securing portion 36 from the first contacts 31 and the second contacts 32 respectively, the angle of the first bending portion 341 of the first contacts 31 is larger than that of the second contacts 32. Thirdly, bending the third bending portion 343 at a lower portion of the body portions 34, then the angle between the soldering portion 35 and the horizontal of the first contact 31 is similar to that of the second contact 32. The main portion 345 of the first contact 31 is formed between the first bending portion 341 and the third bending portion 343 and extends obliquely along the front to back direction.

Fourthly, inserting the first and second contacts 31, 32 into the passageways 2013, the securing portions 36 engage with the inside walls of the passageways 2013 for retaining the contacts 3 therein. The lower portions of the first and second contacts 31, 32 are located at one row along the front to back direction at this time. Fifthly, bending the second bending portions of the first and second contacts 31, 32 by one time. The second bending portions 342 of the first and second contacts 31, 32 will be arranged at one row and located at a common arc face. All soldering portions 35 will be located at a common plane. The coplanarity of all soldering portions 35 will be improved. The main portion 345 of the second contacts 32 is formed between the first bending portion 341 and the second bending portion 342.

Figure 8:
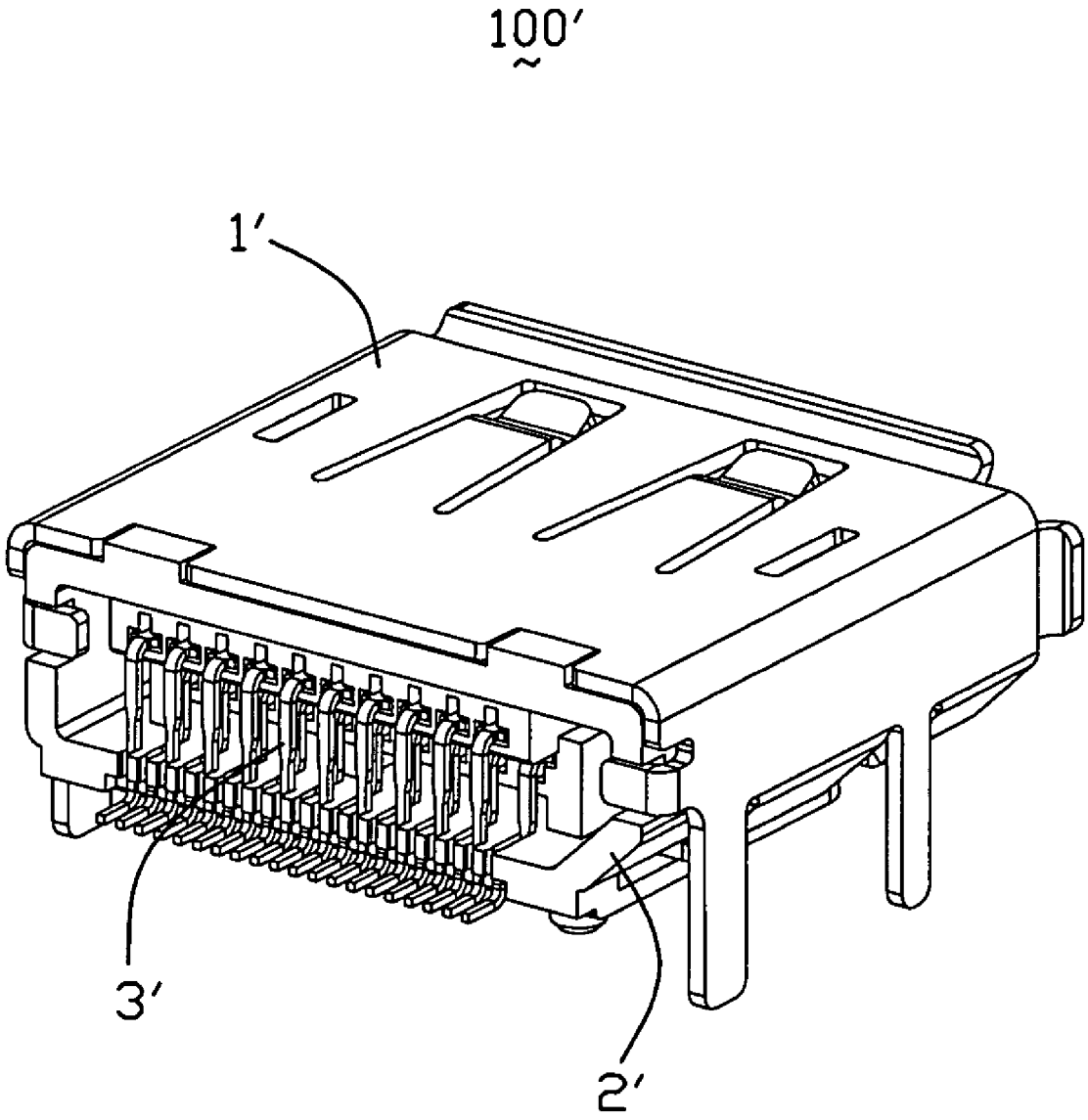
FIG. 8 is a perspective view of an electrical connector according to another embodiment of the present invention.
Figure 9:
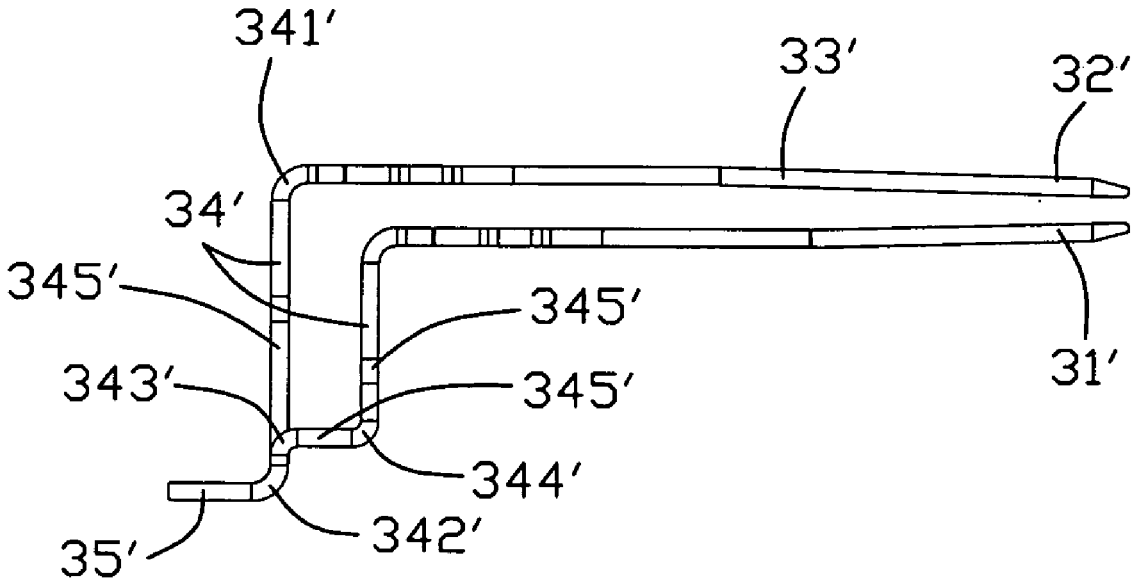
FIG. 9 is a perspective view of contacts according to another embodiment of the present invention.
Figure 10:
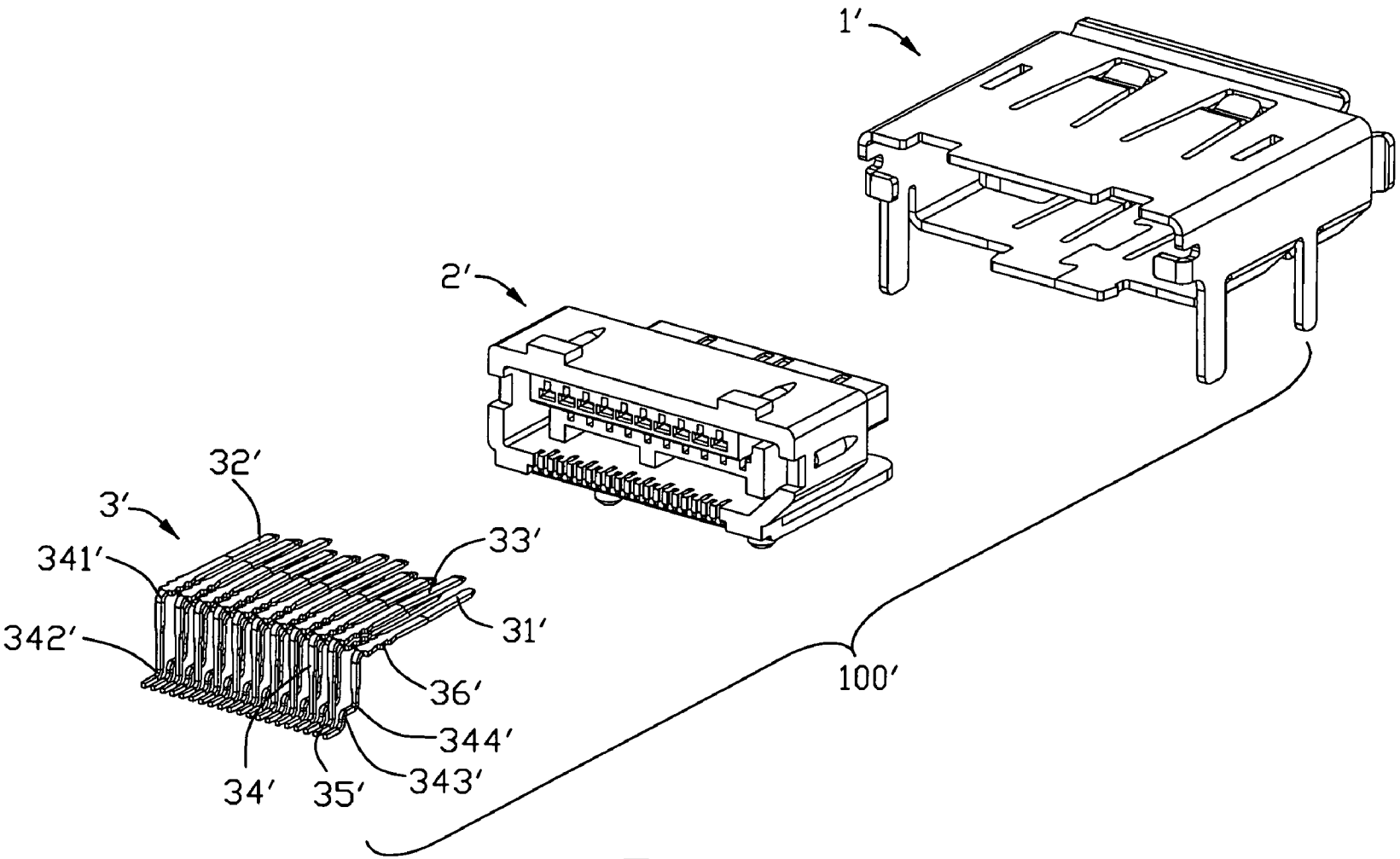
FIG. 10 is a left side elevational view of the FIG. 9.

Referring to FIGS. 8-10, another embodiment of the electrical connector 100' are shown. The structure of the electrical connector 100' is approximately similar with above embodiment. The electrical connector 100' also comprises an insulative housing 2', a plurality of contacts 3' retained therein and a metal shield 1' enclosing the insulative housing 2'. The contacts 3' comprise a group of first contacts 31' and a group of second contacts 32'. Each contact 3 has a body portion 34', a contact portion 33', a soldering portion 35' and a securing portion 36' engaging with the insulative housing 2'. Each body portion 34 has a first bending portion 341' joined with the contact portion 33', and a second bending portion 342' joined with the soldering portion 35'.

The difference is that the angle of the first bending portion 341' on the first contact 31' is similar to that of the second contact 32'. The body portion 34' of the first contact 31' has a third bending portion 343' and a fourth bending portion 344' for making the second bending portions 342' of the first and second contacts 31', 32' located at a common arc face. Therefore, the soldering portions 35' of the first and second contact 31', 32' will be arranged in one row and located at a common plane. The coplanarity of the soldering portions will be improved for favoring the contacts 3 to solder to the circuit board firmly. In this embodiment, the main portion 345' of the first contacts 31 between the first bending portion 341' and the third bending portion 343' has a vertical portion and a level portion. The fourth bending portion 344' joins the vertical portion and the level portion together.

According to the present invention, the body portions 34, 34' of the first and second contacts 31, 31', 32, 32' are arranged in two rows along the front to back direction for decreasing the crosstalk. In addition, all soldering portions 35, 35' can be stamped by one time via setting a third bending portion 343, 343'. Therefore, the soldering portions 35, 35' can be arranged in one row and located at a common plane. The coplanarity of all soldering portions 35, 35' is improved. It will be convenient to solder the contacts 3, 3' on the circuit board firmly for ensuring the signal transmission.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

an insulative housing;

a plurality of contacts retained in the insulative housing, the contacts comprising a group of first contacts and a group of second contacts, each contact having a body portion, a contact portion and a soldering portion being adapted to be surface-mounted to a circuit board, the body portion has a first arc-shaped bending portion downwardly from the contact portion, and a second arc-shaped bending portion bending outwardly from a lower end of the body portion to connect the soldering portion; and a metal shield enclosing the insulative housing;

wherein the body portions of the first contacts and the second contacts are arranged in two rows along a front to back direction, the body portion of the first contact comprising a third bending portion bending obliquely and downwardly a from a lower side of the body portion and located between the first bending portion and the second bending portion.

2. The electrical connector according to claim 1, wherein the second bending portions of the first contacts and the second contacts are located in a common arc face.

3. The electrical connector according to claim 2, wherein the soldering portions of the first contacts and the second contacts have same length.

4. The electrical connector according to claim 3, wherein the body portions of the first contacts are located at a front row close to a front end of the insulative housing, while the body portions of the second contacts are located at a rear row behind the front row and staggered with the first contacts.

5. The electrical connector according to claim 1, wherein the insulative housing defines a plurality of slots at a rear end thereof for receiving the body portions therein.

6. The electrical connector according to claim 1, wherein the insulative housing comprises a tongue extending forwardly, the contact portions of the second contacts exposed out of an upper face of the tongue, the contact portions of the first contacts exposed out of a lower face of the tongue, and staggered with the second contacts along a height direction of the insulative housing.

7. The electrical connector according to claim 6, wherein the tongue has a pair of ribs extending downwardly from two sides thereof.

8. The electrical connector according to claim 1, wherein each contact has a securing portion between the contact portion and the body portion, the insulative housing defining a plurality of passageways engaging with the securing portions.

9. The electrical connector according to claim 1, wherein the metal shield comprises a top wall, a bottom wall and a left wall and a right wall, the left wall being parallel to the right wall and shorter than the right wall.

10. A method of making an electrical connector, comprising:

stamping a group of first contacts and a group of second contacts from two pieces of metal sheet respectively, each contact comprising a contact portion, a securing portion, a body portion and a soldering portion which are all located in a common plane, the contact portions of the first contacts being shorter than that of the second contacts;

bending a firs arc-shaped bending portion downwardly at a rear end of each securing portion;

bending a third bending portion obliquely and downwardly at a lower portion of the body portion of each first contact, the angle between the soldering portion and the horizontal of the first contact being similar to that of the second contact;

providing an insulative housing and assembling the first and second contacts in the insulative housing, the lower portions of the body portions of the first and second contacts being located at one row along a front to back direction; and finally, bending a second arc-shaped bending portion at a lower end of the body portion of all contacts by one time, the soldering portions of all contacts being in a common plane.

11. The method of making the electrical connector according to claim 10, wherein the body portions of the first contacts and the second contacts are arranged in two rows along the front to back direction.

12. The method of making the electrical connector according to claim 10, wherein the second bending portions of the first contacts and the second contacts are located in a common arc face.

13. The method of making the electrical connector according to claim 10, wherein the angle of the first bending portion of the first contact is larger than that of the second contact.

14. The method of making the electrical connector according to claim 10, wherein the angle of the first bending portion of the first contact is similar to that of the second contact.

15. The method of making the electrical connector according to claim 14, comprising bending a fourth bending portion before bending the third bending portion, the body portion of the first contact has a vertical portion parallel to the second contact and a level portion, and the third bending portion joins the vertical portion and level portion together.

16. An electrical connector comprising:

an insulative housing including a forwardly extending mating tongue defining opposite upper and lower mating surface;

a plurality of upper contacts and a plurality of lower contacts disposed in the housing, each of said upper contacts including an upper retention section and an upper mating section commonly located at an upper level, and an upper tail section extending rearwardly from the upper retention section, each of said lower contacts including a lower retention section and a lower mating sections commonly located at a lower level, and a lower tail section extending rearward from the lower retention section;

said lower tail sections and said upper tail sections arc alternately arranged in one transverse line on a rear side of the housing; wherein both said upper tail sections and said lower tail sections define a row of lying right angle L-shaped solder ends which are allowed to be formed via a common bending process while other portions of the upper tail sections extending upwardly from the corresponding L-shaped solder ends, respectively, without any forward extension thereof while other portions of the lower tail sections extending not only upwardly but also forwardly.

17. The electrical connector as claimed in claim 16, wherein said other portion of each of said lower tail sections includes an oblique extension linking to the corresponding retention section.

18. The electrical connector as claimed in claim 16, wherein said other portion of each of the lower tail sections includes another L-shaped structure linking to the corresponding retention sections under a condition that a direction of said another L-shaped structure is opposite to that of the L-shaped solder end of the corresponding lower tail section.

* * * * *